United States Patent [19]

Toshimitsu et al.

[11] Patent Number: 4,860,049

[45] Date of Patent: Aug. 22, 1989

[54] IMAGE FORMING APPARATUS

[75] Inventors: Kenshi Toshimitsu; Takashi Mizuma, both of Kawasaki, Japan

[73] Assignee: Kabushiki Kaisha Toshiba, Kanagawa, Japan

[21] Appl. No.: 184,977

[22] Filed: Apr. 22, 1988

[30] Foreign Application Priority Data

Apr. 30, 1987 [JP] Japan ..... 62-106829
May 30, 1987 [JP] Japan ..... 62-136320

[51] Int. Cl.[4] ..... G03G 15/00; G03G 15/01

[52] U.S. Cl. ..... 355/218; 355/328; 355/245

[58] Field of Search ..... 355/7, 4, 3 R, 14 R; 346/140 R, 75, 160

[56] References Cited

U.S. PATENT DOCUMENTS 4,690,543 9/1987 Watanabe ..... 355/4
4,707,713 11/1987 Ayata et al. ..... 355/7 X
4,708,486 11/1987 Watanabe ..... 355/7 X
4,710,016 12/1987 Watanabe ..... 355/4
4,740,811 4/1888 Watanabe ..... 355/7 X
4,761,673 8/1988 Watanabe et al. ..... 355/14 R
4,777,510 10/1988 Russel ..... 355/7

FOREIGN PATENT DOCUMENTS 61-219975 9/1986 Japan .
62-5275 1/1987 Japan .

*Primary Examiner*—A. C. Prescott
*Attorney, Agent, or Firm*—Foley & Lardner, Schwartz, Jeffery, Schwaab, Mack, Blumenthal & Evans

[57] ABSTRACT

An image forming apparatus has a rotatable image carrier for carrying electrostatic latent images thereon and a scanner having a prescribed scanning direction for exposing the image carrier to form the electrostatic latent images corresponding to the pattern of an original document on the image carrier. The apparatus includes a designating section for designating first and second rectangular areas of the original document to be copied, and a first and second developing units for converting the electrostatic latent images corresponding to the first and second areas, respectively, into first and second different color toner images on the image carrier. The first and second developing units are selectively actuated to form the first and second color toner images alternatively on the image carrier, the first and second color toner images are transferred from the image carrier onto a sheet having a defined length and width corresponding to the length and width of the original document in a single rotation of the image carrier when the width of both of the first and second areas correspond to the width of the sheet.

10 Claims, 13 Drawing Sheets

IMAGE FORMING APPARATUS

BACKGROUND OF THE INVENTION

1. Field of the Invention

The present invention relates to an image forming apparatus with a plurality of color. In particular, the invention relates to an electrophotographic copying machine which can selectively form a different color image from that of the other portions by designating a required area of an original document.

2. Discussion of Background

As already known, various electronic copying machines have been developed by which it is possible to designate a required portion of an original document placed on the original document table using a designating means such as a spot light source and to develop that portion using a different color from other portions.

In the above image forming apparatus, as shown in FIG. 1A, when a first exposure scan is carried out, for instance, an image is developed which is the portion outside the area of an original document G which has been designated (that portion shown by diagonal shading). While the electrostatic latent image of the designated area is erased from the photosensitive drum using an erasure means of charging which is a so-called erasure array so that the portion erased from the photosensitive drum will not be developed. After this developed image has been transferred onto a sheet, the sheet is guided to a sheet transport device which is called a multicopying unit via a fixing unit.

On the other hand, when a second exposure scan is carried out, only the image of the designated portion (that portion shown by diagonal shading) is developed. While the image of the portion other than the designated portion is erased by the erasure array so that it is not developed. Then, this developed image is transferred onto the sheet on to which the image of other than the designated area has been transferred, which is supplied from the multicopying unit. By carrying out such operations as these, the required portion can be copied in the required color.

However, when changing the developing color of an original document image by partial designation, as shown in FIG. 1B, there are cases when a change of the developing color is designated for the whole image in the direction (the x direction) which is orthogonal to the exposure-scanning direction (the y direction) of original document G. In the past, even when this type of designation was carried out, the image had to be copied by carrying out two exposure scans and developing the designated portion and portion which was not designated by separate processes as described above. For this reason, copying took long time. Also, since the sheet passed through the fixing unit in the first image formation process, curling of the sheet occurred and, in the second image formation process, it was difficult accurately to place it in contact with the reference position on the photosensitive drum when the sheet was supplied from the multicopying unit. Thus there was the drawback of position slippage occurring between the image formed in the second image formation process and the image formed in the first image formation process.

SUMMARY OF THE INVENTION

It is an object of the present invention to provide an image forming apparatus which can shorten the time required for image formation by forming an image of a designated portion and an image of other than that designated portion with a single-pass image formation process when a whole area orthogonal to the direction of scan of the original document is designated.

It is another object of the present invention to provide an image forming apparatus which can prevent slippage between the image of the designated portion and the image of other than the designated portion.

According to one aspect of the present invention, there is provided an image forming apparatus comprising rotatable image carrier means for carrying electrostatic latent images thereon; scanning means having a prescribed scanning direction for exposing the image carrier means to form the electrostatic latent images corresponding to the pattern of an original document on the image carrier means; means for designating first and second rectangular areas of the original document to be copied; developing means having first and second developing units for converting the electrostatic latent images corresponding to the first and second areas, respectively, into first and second different color toner images on the image carrier means; means for selectively actuating the first and second developing units; and means for transferring the first and second color toner images from the image carrier means onto a sheet having a defined length and width corresponding to the length and width of the original document in a single rotation of the image carrier means when the widths of both of the first and second areas correspond to the width of the sheet.

BRIEF DESCRIPTION OF THE DRAWINGS

These and other objects and advantages of this invention will become more apparent and more readily appreciated from the following detailed description of the presently preferred exemplary embodiments, taken in conjunction with the accompanying drawings of which:

FIGS. 14 to 15B show a second embodiment of an image forming apparatus according to the present invention, in which:

FIG. 14 is a side sectional view showing developing units used in the image forming apparatus;

FIGS. 15A and 15B are schematic illustrations for explaining the operation of the developing units shown in FIG. 14;

DETAILED DESCRIPTION OF THE PREFERRED EMBODIMENTS

One of the preferred embodiment of the present invention will be described with reference to the accompanying drawings.

Figure 1A:
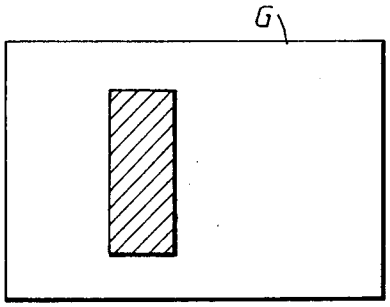
FIGS. 1A and 1B are plan views of original documents for explaining the designation of the color change areas.
Figure 1B:
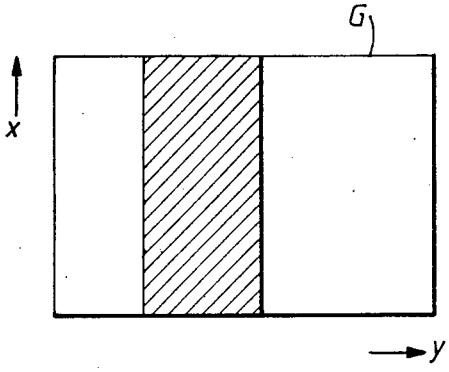
Figure 2:
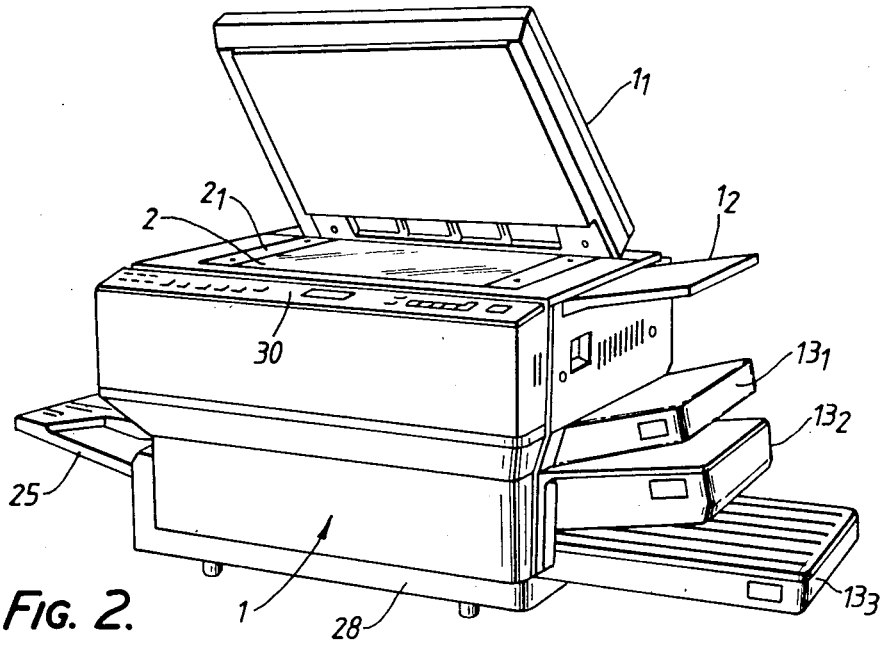
FIG. 2 is a schematic perspective view showing the construction of an image forming apparatus.
Figure 3:
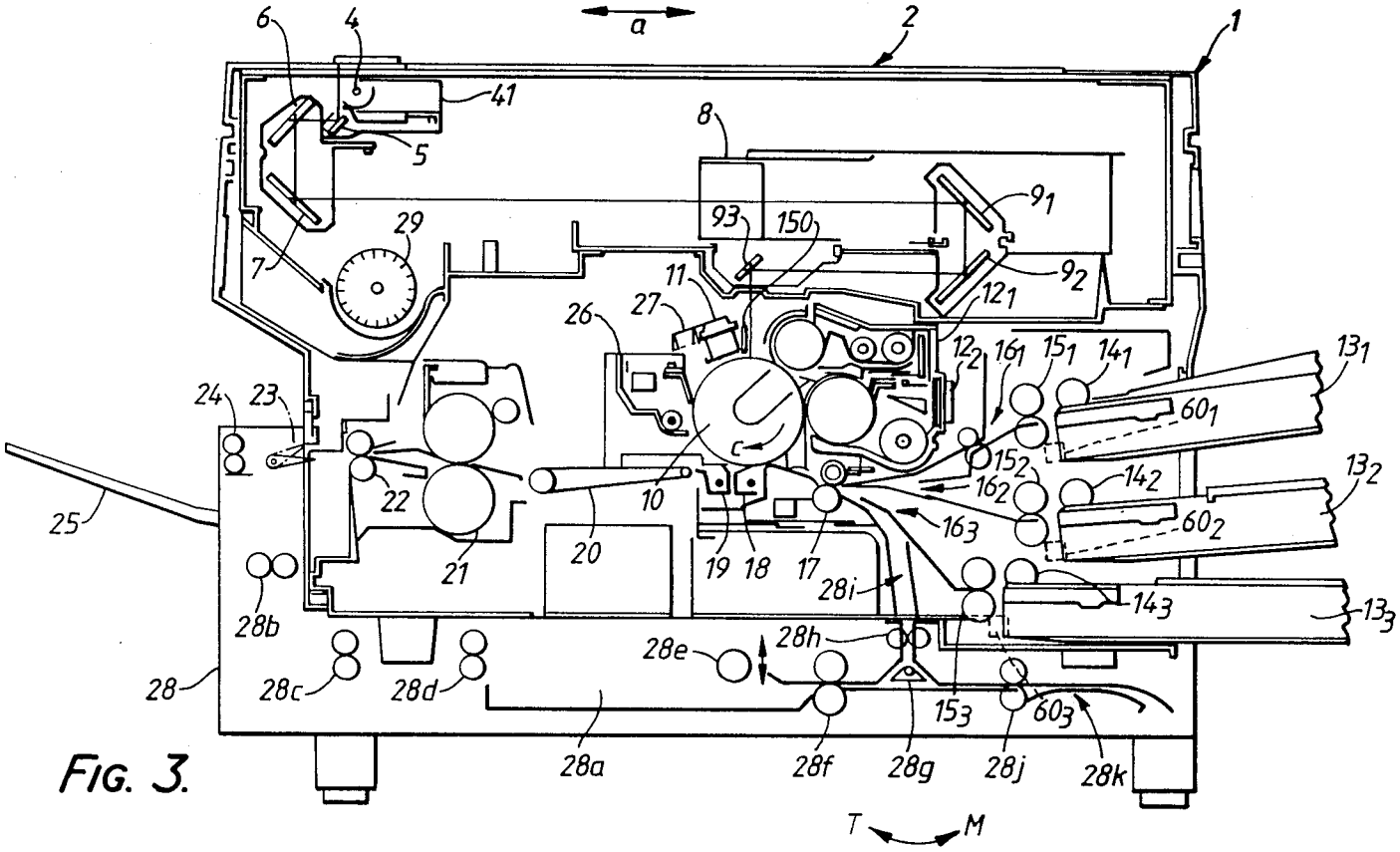
FIG. 3 is a side sectional view showing the construction of the image forming apparatus.

FIGS. 2 and 3 schematically show a copying machine as an image forming apparatus according to a first embodiment of the present invention. Reference number 1 denotes a coyping machine housing. An original table 2 (i.e., a transparent glass) which support the original documents is provided on the upper surface of housing 1. A fixed scale $2_1$ is a reference for setting the original document at an end of original table 2. An openable original cover $1_1$ and a work table $1_2$ are provided close to original table 2.

The original document placed on original table 2 is scanned by an optical system consisting of an exposure lamp 4 and mirrors 5, 6 and 7 moving reciplocatively in the direction of the arrow a along the underside of original table 2. In this case, mirrors 6 and 7 move at half the speed of mirror 5 so as to maintain a fixed optical path length. The light reflected from the original document as a result of the scanning by the optical system, i.e., the light reflected from the original document as a result of illumination by the light from exposure lamp 4, passes through a lens block 8 capable of providing various different magnifications after being reflected by mirrors 5, 6 and 7, and is then guided to a photosensitive drum 10 by reflection from mirrors $9_1$, $9_2$ and $9_3$, to form an image of the original document on the surface of photosensitive drum 10.

Photosensitive drum 10 rotates in the direction indicated by arrow c so that its surface is wholly charged first by a main charger 11. The image of the original document is projected on the charged surface of photosensitive drum 10 by slit exposure, forming an electrostatic latent image on the surface. The electrostatic latent image is converted into visible image by the adhesion of for example red or black toner, stored in and selectively operated with developing units $12_1$ and $12_2$ as required. These developing units $12_1$ and $12_2$ are designed to be able independently to be in contact with, or to be separated from, photosensitive drum 10.

Copy paper sheets P are delivered one by one from a selected one of an upper paper-feed cassette $13_1$, middle paper-feed cassette $13_2$ or lower paper-feed cassette $13_3$, by paper-supply roller $14_1$, $14_2$ or $14_3$ and a pair of roller $15_1$, $15_2$ or $15_3$. Sheets P are guided along paper guide path $16_1$, $16_2$ or $16_3$ to an aligning roller pair 17. Then, each copy paper sheet P is delivered to a transferring station by the aligning roller pair 17, timed to the formation of the visible image.

Paper-feed cassettes $13_1$, $13_2$ and $13_3$ are removably attached to the lower part of the right side of housing 1, and any of them can be selected by operating an operating panel which will be described in detail later. The cassette size of each of paper-feed cassettes $13_1$, $13_2$ and $13_3$ is detected by cassette size detecting switches $60_1$, $60_2$ and $60_3$. These cassette size detecting switches $60_1$, $60_2$ and $60_3$ are each formed of a plurality of microswitches which are turned on or off in response to insertion of cassettes of different sizes.

Paper sheet P delivered to the transferring station comes into intimate contact with the surface of photosensitive drum 10, in the space between the transfer charger 18 and drum 10. As a result, the toner image on photosensitive drum 10 is transferred onto paper sheet P by charger 18. After the transfer, paper sheet P is separated from photosensitive drum 10 by a separation charger 19 and transported by a conveyor belt 20. As paper sheet P passes through a fixing roller 21, the transferred image is fixed on paper sheet P. After the fixation, paper sheet P is discharged by a pair of delivery rollers 22, a director gate 23 operated in the position shown by the solid line, and pair of discharge rollers 24, on to a tray 25 outside housing 1. After the transfer, any toner remaining on the surface of photosensitive drum 10 is removed a cleaner 26. Thereafter, an image remaining on drum 10 is erased by a discharge lamp 27 to restore the initial state. Numeral 29 designates a cooling fan for preventing the temperature inside housing 1 from rising.

A multicopying unit 28, which permits copying on both sides of a paper sheet, or multiple copies on the same side, is provided at the bottom of housing 1. Thus unit 28 is provided with pairs of rollers 28*b*, 28*c* and 28*d* which guide the copy sheet, which has been initially directed to unit 28 by director gate 23 and discharge rollers 24, to a storage part 28*a*. It is provided also with a delivery roller 28*e* for delivering sheet which has been temporarily stored in storage part 28*a*. This delivery roller 28*e* can move up or down in the direction of the arrow in the drawing, according to the thickness (number of paper sheets) of the sheet stored. The paper sheet delivered by delivery roller 28*e* is guided, via a pair of separating rollers 28*f* which separate one sheet at a time, to a control gate 28*g*. When multiple copying is required, this control gate 28*g* turns in the direction of the arrow M in the drawing, and the paper sheet is conveyed via the pair of conveyor rollers 28*h* and a paper guide route 28*i* to aligning roller pair 17. When copying on both sides is required, the paper is guided via a pair of conveyor rollers 28*j* to a reversing unit 28*k*, control gate 28*g* turns in the direction of arrow T in the drawing, and the paper sheet, sent by conveyor rollers 28*j*, is guided via conveyor rollers 28*h* and paper guide route 28*i* to aligning roller pair 17. In this embodiment, control gate 28*g* is normally turned in the direction of arrow M, permitting multiple copying only.

Figure 4:
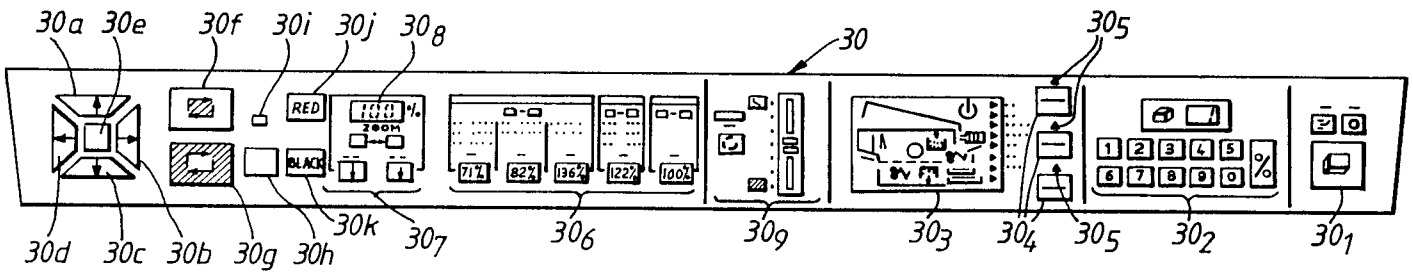
FIG. 4 is a plan view of an operating panel.

FIG. 4 shows an operating panel 30 provided on housing 1. Operating panel 30 carries thereon a copy key $30_1$ for starting the copying operation, a keyboard $30_2$ for setting the number of copies to be made and the like, a display section $30_3$ for indicating the operating conditions of the individual parts or sheet jamming, cassette selection keys $30_4$ for selecting upper, middle or lower paper cassette $13_1$, $13_2$ or $13_3$, and cassette display sections $30_5$ for indicating the selected cassette. Operating panel 30 is further provided with ratio setting keys $30_6$ for setting the enlargement or reduction ratio of copy selected among several predetermined ratios, zoom keys $30_7$ for adjustably setting the enlargement or reduction ratio, a display section $30_8$ for displaying the set ratio, and a density setting section $30_9$ for setting the copy density. Additionally arranged on controll panel 30 are operation keys 30*a*, 30*b*, 30*c* and 30*d* for shifting a spot light source (mentioned later) which serves to indicate as erasing positions of the original document, and a position designating key 30*e* for inputting the coordinate positions indicated by the spot light source. Further arranged on operating panel 30 are erasure area designating keys 30*f* and 30*g* for designating an erasure area in the position designated, a color change key 30*h* for changing the color of the image, a light-emitting element 30*i* for showing that color change key 30*h* has been operated, a red designating key 30*j* for designating to use developing unit $12_1$ in which red toner is contained, and a black designating key 30*k* for designating to use developing unit $12_2$ in which black toner is contained.

The designation of the area for color change of the original document will now be described in detail.

Figure 5:
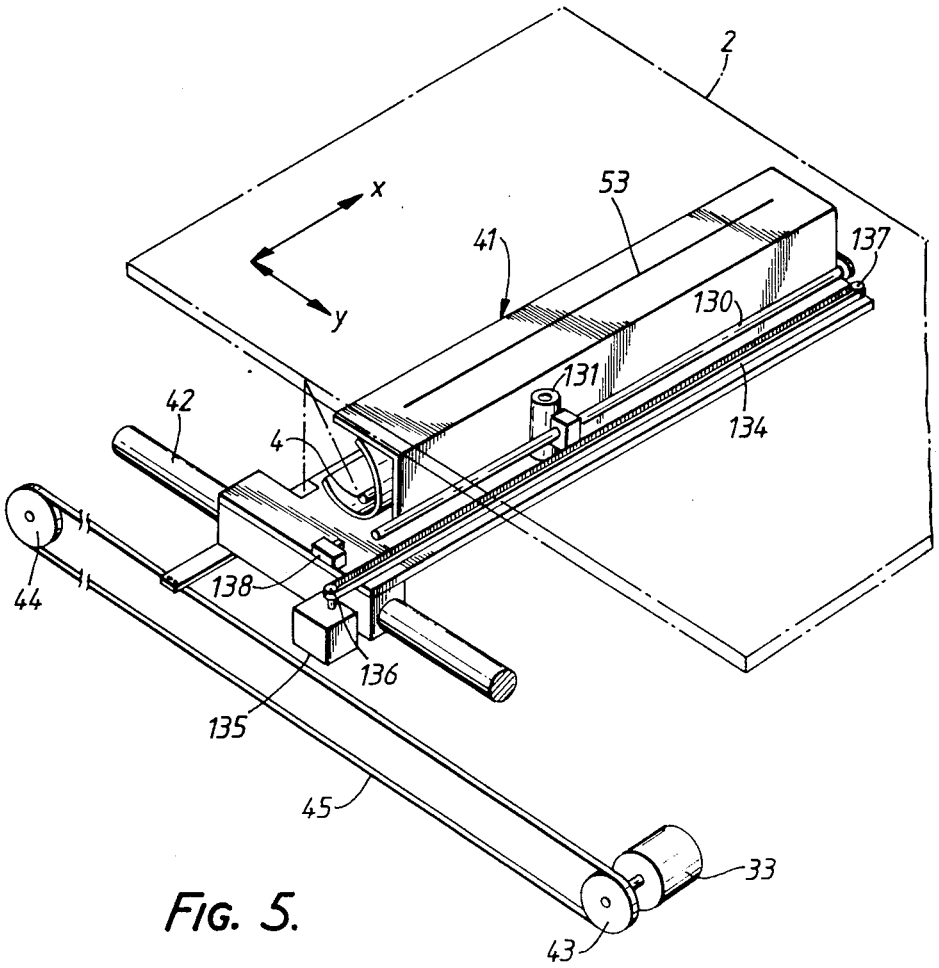
FIG. 5 is a perspective view of the principal part including a spot light source.
Figure 6:
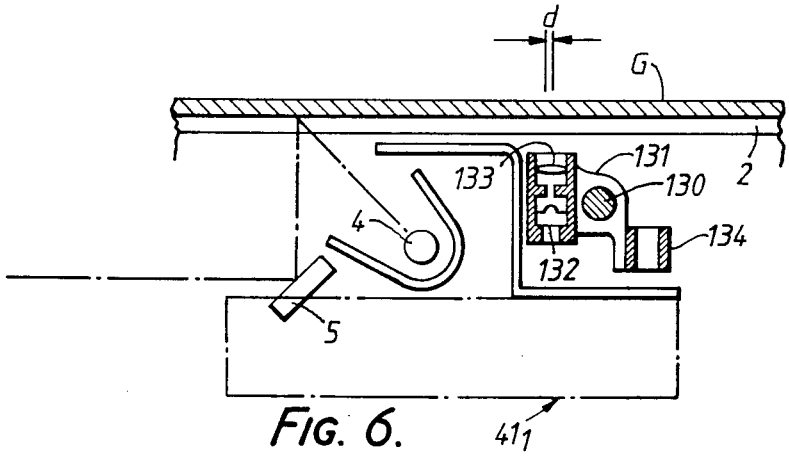
FIG. 6 is a side sectional view of the principal part including the spot light source.

In FIGS. 5 and 6, a carriage 41 can move parallel in the direction y, guided by a guide rail 42. A pulse motor 33 drives a pulley 43. An endless belt 45 is stretched between pulley 43 and an idle pulley 44, and one end of carriage 41 is fixed to the middle portion of endless belt 45. With this arrangement, when pulse motor 33 is driven, endless belt 45 turns around to move carriage 41. The traveling direction of carriage 41 is controlled by changing the rotating direction of pulse motor 33.

A guide shaft 130 is disposed at that portion of carriage 41 intercepting the light from lamp 4, extending along lamp 4. On guide shaft 130, a spot light source 131 is movably mounted as the means of designating the area for color change of the original document. As shown in FIG. 6, spot light source 131 includes a light emitting element 132, such as a light emitting diode or lamp, and a lens 133 which are opposed to original table 2.

A light beam emitted from light emitting element 132 is applied to original table 2 through lens 133, as a spot light with a diameter d of, e.g., 2 mm. The spot light has enough brightness to be transmitted through the original document as thick as, e.g., a post-card set on original table 2. Spot light source 131 is coupled to a timing belt (toothed belt) 134 extending along guide shaft 130. Timing belt 134 is stretched between a pulley 136 mounted on the shaft of a stepping motor 135 and a driven pulley 137. As stepping motor 135 is rotated, spot light source 131 is moved in the direction x perpendicular to the scanning direction y of carriage 41. A position sensor 138 formed of a microswitch for detecting the initial position of spot light source 131 is attached to that portion of carriage 41 which is located beside the end portion of guide shaft 130 of the side of stepping motor 135. When spot light source 131 is moved, for example, it first abuts against position sensor 138 to have its initial position detected thereby.

Figure 7:
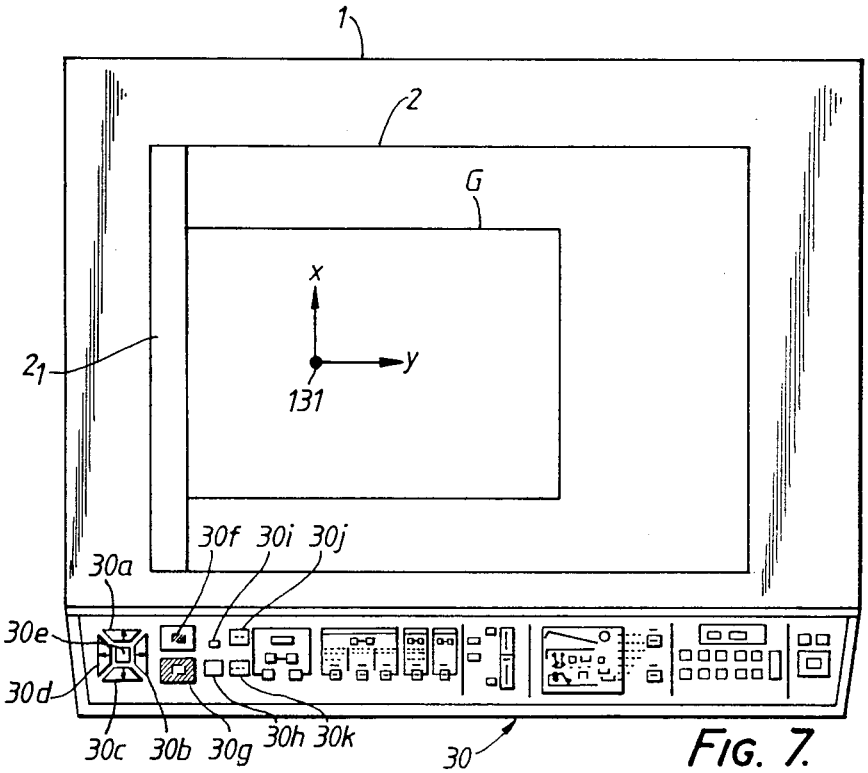
FIGS. 7 and 8 are plan views illustrating an operation for designating the color change areas of the original document using the spot light source.
Figure 8:
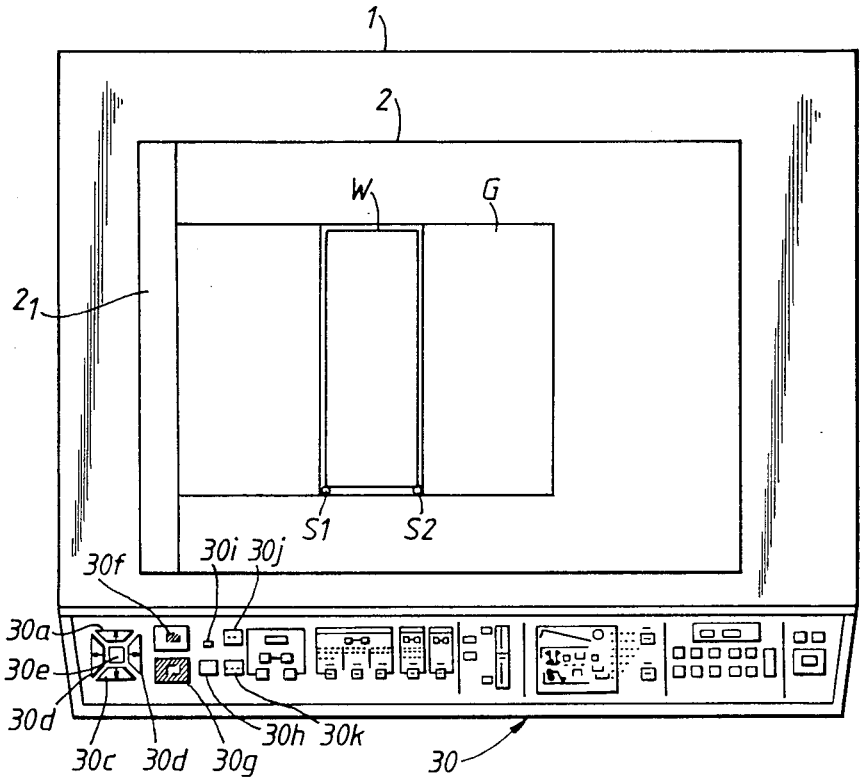

Referring now to FIGS. 7 and 8, there will be described a method for designating the color change areas of the original document by means of spot light source 131. When designating an area of an original document to be color changed, an original document G is set with the surface to be copied face upwards at the setting scale $2_1$ end, as shown in FIG. 7. In this state, spot light source 131 is moved, with light emitting element 132 switched on, by operating the operation keys 30*a* to 30*d*. When the operation keys 30*b* and 30*d* are depressed, motor 33 is started, and carriage 41 and spot light source 131 are moved in the scanning direction (indicated by arrow y in FIG. 7). When the operation keys 30*a* and 30*c* are depressed, on the other hand, motor 135 is started, and spot light source 131 is moved in a direction (indicated by arrow x in FIG. 7) perpendicular to the scanning direction.

When the multi-colored copy mode is selected, observing the spot light transmitted through original document G, the opertor operates the operation keys 30*a* to 30*d*. When the spot light reaches, for example, a spot S1 on original document G shown in FIG. 8, the operator depressed the position designating key 30*e*. Thereupon, the x coordinate position indicated by spot S1 is stored in a controller 61 shown in FIG. 10. Likewise, if the position designating keys 30*e* is depressed when a spot S2 on original document G is reached by the spot light, the x coordinate position indicated by spot S2 is stored in controller 61. This position of the spot light can be detected by, for example, counting drive pulse delivered from stepping motor 33. By this means, the area outside the frame W which is formed by spot S1 and spot S2, as shown in FIG. 8, is designated as one color area (the standard color, black) and the area inside frame W is designated as another color area (the alternate color, red).

Original document G for which the color change area has been designated in the above way, is reversed in the x direction shown in FIG. 7. Then original document G is set against fixed scale 21 and copied in the state in which the surface to be copied is face downwards.

Also, an erasure array is provided between main charger 11 and developing unit $12_1$, as shown in FIG. 3. This erasure array 150 is constructed by arranging multiple light-emitting elements across the width of photosensitive drum 10. The charge which has been applied to photosensitive drum 10 is eliminated by the turning on these light-emitting elements in response to the area designated by spot light source 131 when forming an image. The image in the portion in which the charge has been eliminated is erased since a latent image will not be formed even though it is exposed.

Figure 9:
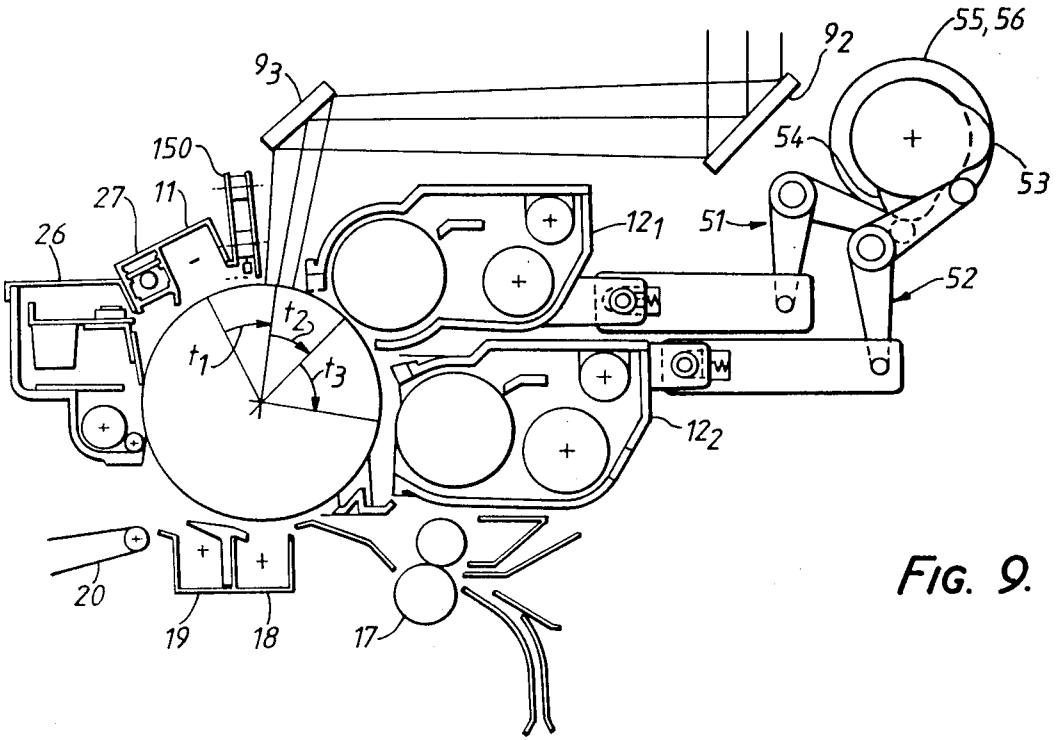
FIG. 9 is a side sectional view showing the essential part of FIG. 3.

FIG. 9 shows a driving unit for developing units $12_1$ and $12_2$. Link members 51 and 52 are provided respectively on developing units $12_1$ and $12_2$ so that link members 51 and 52 trace cams 53 and 54. Cams 53 and 54 are independently rotated by, for instance, pulse motors 55 and 56. Thus it is possible to cause developing units $12_1$ and $12_2$ independently to make contact with, or separate from, photosensitive drum 10. U.S. Pat. No. 4,710,016 (J. Watanabe, Dec. 1, 1987) shows a developing apparatus having a driving unit for developing units which are very similar to the driving unit of the present invention shown in FIG. 9.

Figure 10:
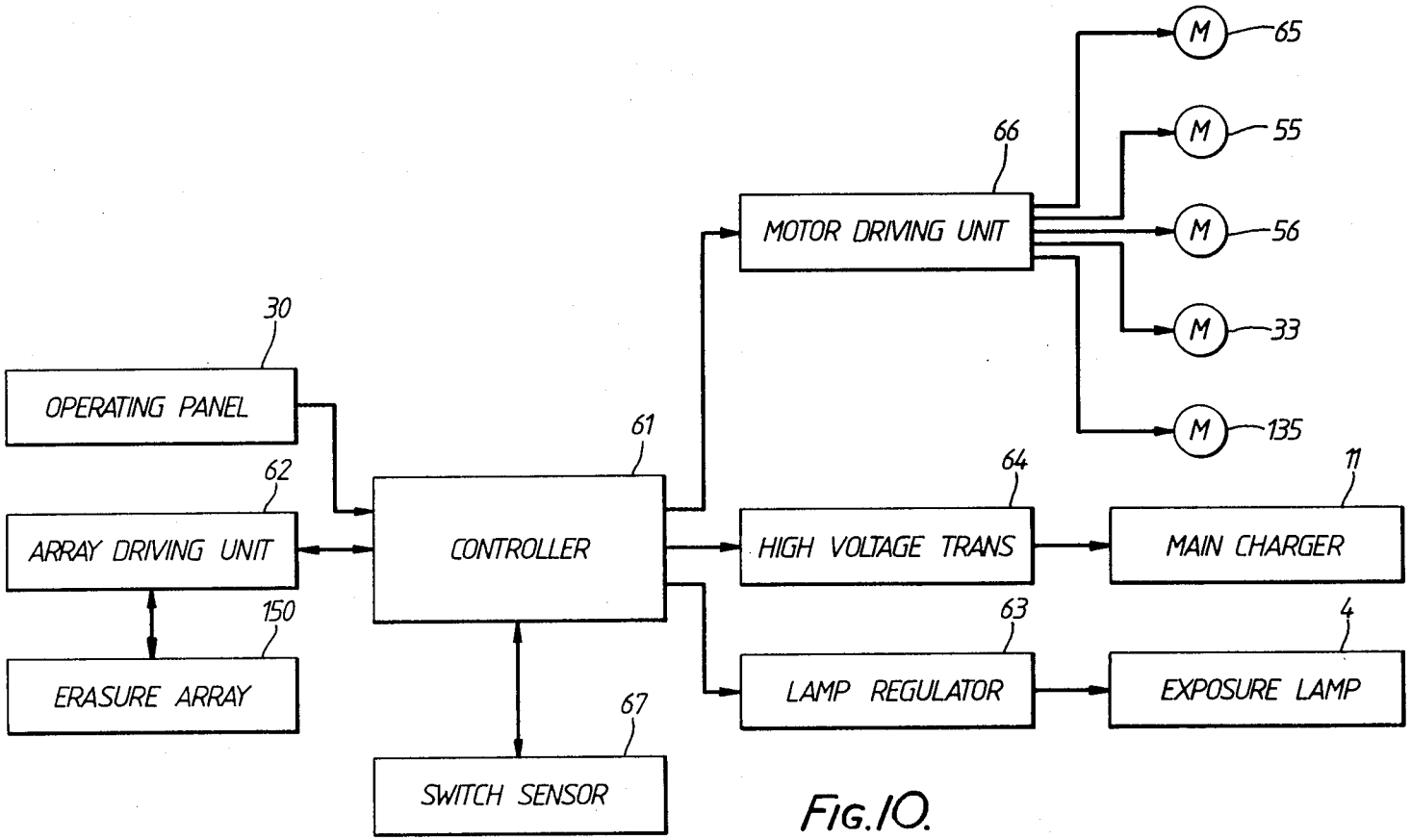
FIG. 10 is a block diagram showing a general control circuit.

FIG. 10 shows a control system of the present invention. A controller 61 controls the overall operation of the copying machine and the following are connected to controller 61. There are operating panel 30, an array driving unit 62 for driving erasure array 150, a lamp regulator 63 for driving exposure lamp 4, a high voltage transformer 64 to which main charger 11 is connected, a switch sensor 67 comprising microswitches $60_1$, $60_2$ and $60_3$ for detecting sheet sizes, and a motor driving unit 66. Motors 55 and 56 for driving developing units $12_1$ and $12_2$, a pulse motor 65 for driving photosensitive drum 10, motors 33 and 135 for driving spot light source 131 are respectively connected to motor driving unit 66.

The operation of the above control system will be now described.

Figure 11:
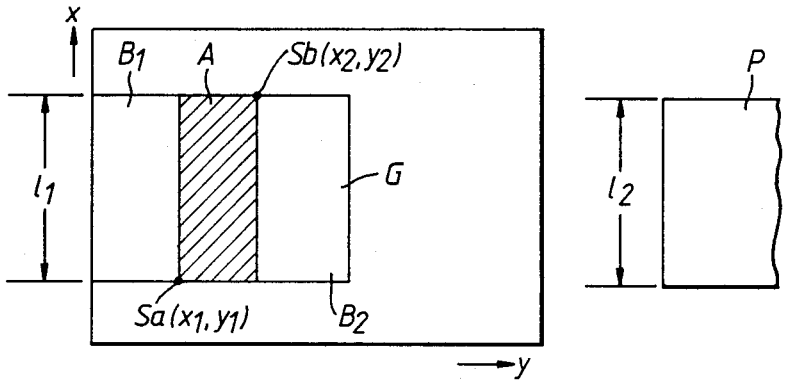
FIG. 11 is a plan view of the original document for explaining the designation of the color change area
Figure 12:
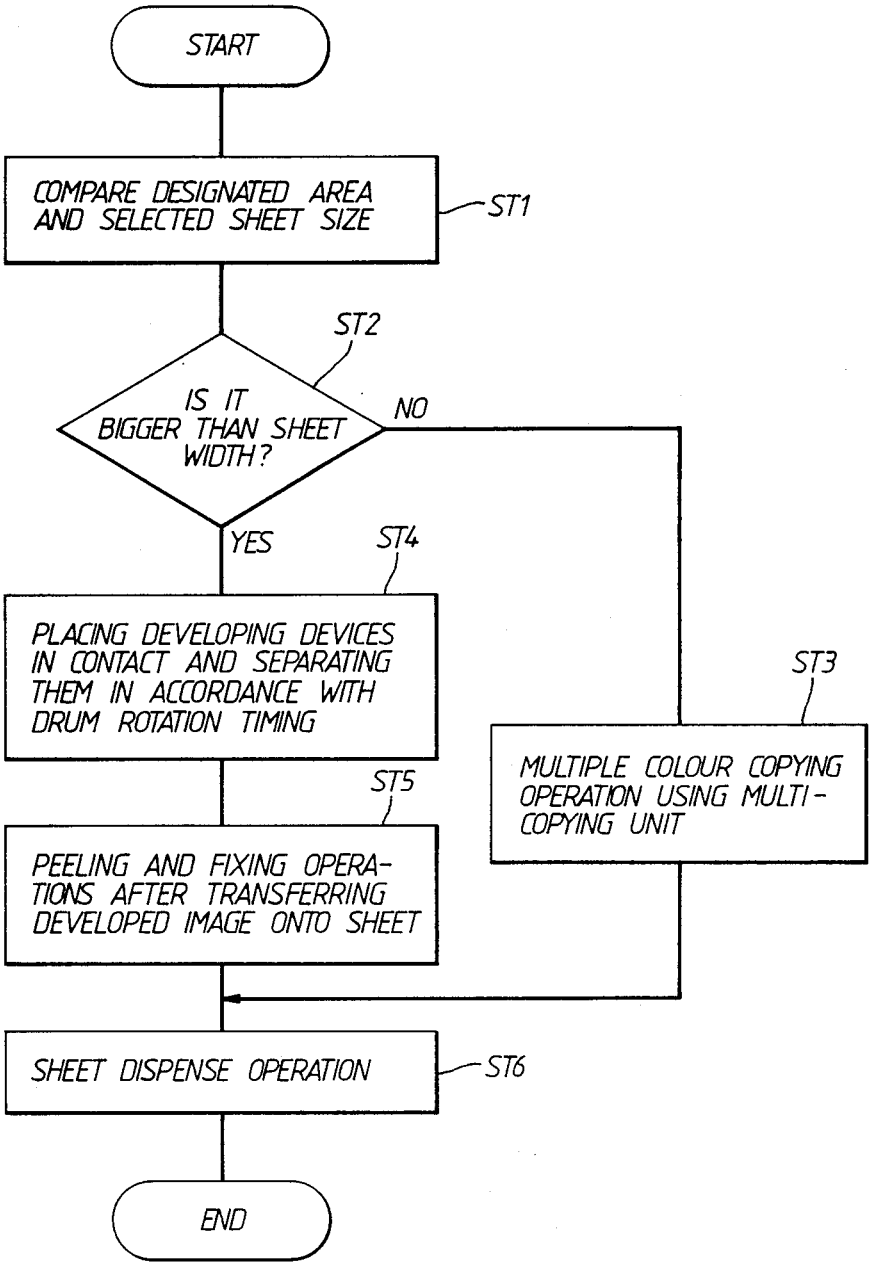
FIG. 12 is a flow chart for explaining a copying operation of the image forming apparatus of the present invention.

As shown in FIG. 11, in the state where original document G is set on original table 2, spot light source 131 is moved by the operation of operation keys 30*a*–30*d* of operating panel 30, and the coordinates Sa ($x_1$, $y_1$) and Sb ($x_2$, $y_2$) of diagonal points of the color change area of the original document are designated. In this state, when, for instance, erasure area designating key 30*g* and copy key $30_1$ on operating panel 30 are operated, controller 61 executes the operations shown in FIG. 12.

Controller 61, first compares the designated color change area and the selected sheet size and discriminates whether or not the length $l_1$ orthogonal to the direction of the exposure scan of the designated color change area (called the x direction length), as shown in FIG. 11, is longer than the width $l_2$ of a sheet P (Steps ST1 and ST2). When the result is that the x direction length $l_1$ of the designated color change area is shorter than the width direction length $l_2$ of sheet P, a multiple color copying operation is executed using multicopying unit 28 described above (Step ST3). The multiple color copying operation using multicopying unit 28 is described in U.S. Pat. No. 4,690,543 (J. Watanabe, Sep. 1, 1987) in detail.

When the x direction length $l_1$ of the designated color change area is longer than the width direction length $l_2$ of sheet P, the multiple color copying operation is executed by a single-pass image formation process by causing developing units $12_1$ and $12_2$ to be in contact with, or separated from, photosensitive drum 10 according to the rotation timing of photosensitive drum 10 and the exposure scan of the original document (Step ST4).

Figure 13:
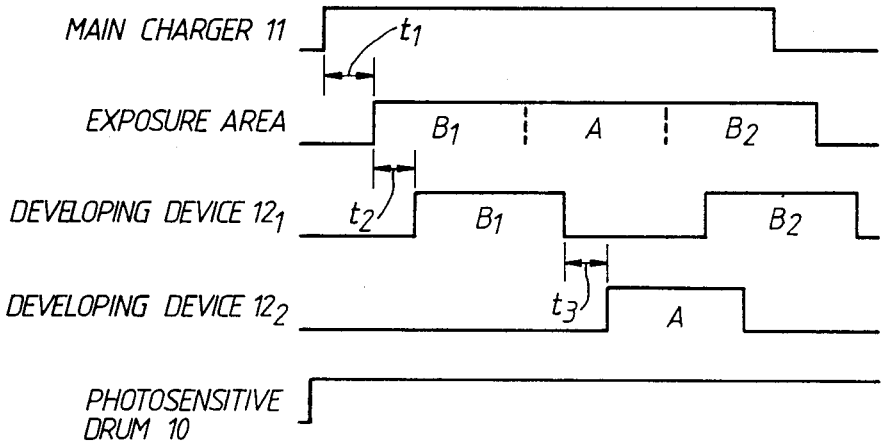
FIG. 13 is a timing chart of the copying operation.

As shown in FIG. 13, developing unit $12_1$ is placed in contact with photosensitive drum 10 after a delay of $t_1+t_2$, which is the time of arrival of the portion of photosensitive drum 10 which has been charged and exposed. At this time, the image of the area of original document G shown by $B_1$ (FIG. 11) is developed by developing unit $12_1$ using, for example, red toner. After this, in the state in which photosensitive drum 10 has rotated for time $t_3$, developing unit $12_2$ is placed in contact with photosensitive drum 10. At this time, the image of the area of original document G shown by A (FIG. 11) is developed by developing unit $12_2$ using, for example, black toner. While this developing is taking place, developing unit $12_1$ is once more placed in contact with photosensitive drum 10. At this time, the image of the area of original document G shown by $B_2$ (FIG. 11) is developed using red toner. After the image developed in this way has been transferred onto sheet P, sheet P is peeled, the image is fixed on sheet P and sheet P is dispensed outside housing 1 (Steps ST5 and ST6).

When the above embodiment is used, the design is such that, if the x direction length $l_1$ of the designated color change area is longer than the width direction length $l_2$ of the selected sheet, multiple color copying is executed by driving developing units $12_1$ and $12_2$ in a single-pass image formation process. Consequently, in the case of this type of designation, the copying time can be shortened in comparison with prior art.

Moreover, since multiple color copying is carried out with a single-pass image formation process, there is no requirement to copy a second image onto a sheet in which curling has occurred due to fixing, and so position slippage of the images is prevented. It is thus possible to prevent picture quality deterioration of the copied image.

Next, a second embodiment of the present invention will be described. Those parts which are the same as in the first embodiment have been given the same reference number.

Figure 14:
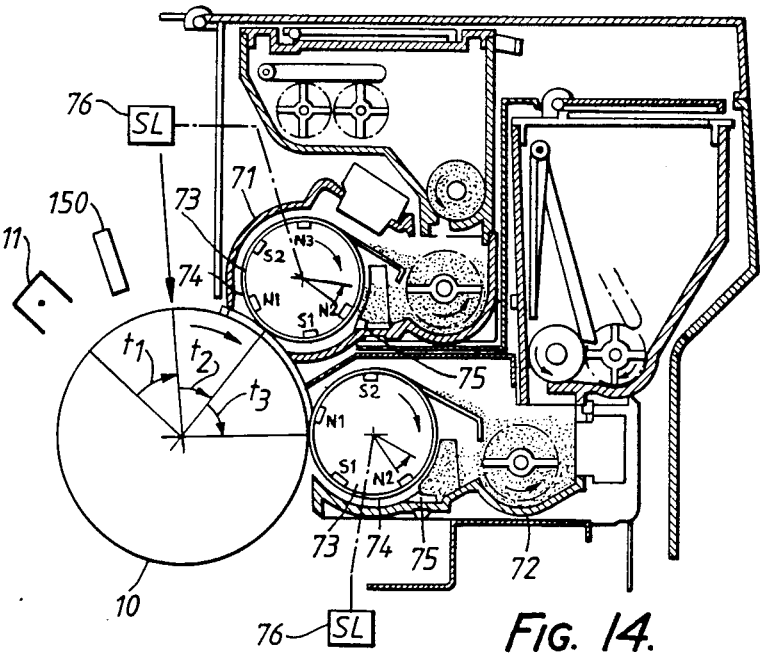
Figure 15A:
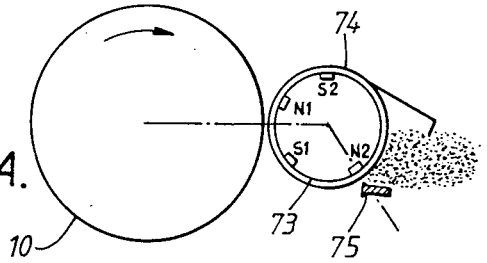
Figure 15B:
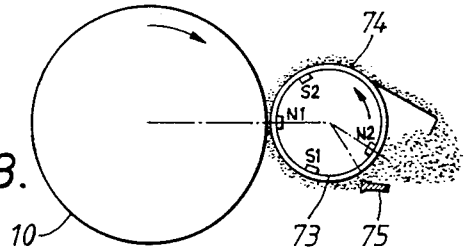

FIG. 14 shows the state when developing units which use magnetic rollers are applied to the present invention. Developing units 71 and 72 are each provided with a sleeve 74 in which a magnetic roller 73 is housed. It is possible to rotate magnetic rollers 73 to a specified angle by driving them with respective solenoids 76 and also to rotate sleeves 74 by respective drive units not shown. As shown in FIG. 15A, a magnetic pole $N_2$, which is provided in magnetic roller 73, faces a leveller 75. Leveller 75 is constructed of a magnetic member. Thus a magnetic flux is formed between magnetic pole $N_2$ and leveller 75 to positively prevent the toner from being carried away. Therefore, even if sleeve 74 is rotated, the toner cannot be supplied to photosensitive drum 10. When magnetic roller 73 is rotated and the positional relationship between magnetic pole $N_2$ and leveller 75 is set to part from each other, as shown in FIG. 15B, the magnetic flux is not formed. Thus it becomes possible to transport the toner to photosensitive drum 10 in conjunction with the rotation of sleeve 74, and so the latent image formed on photosensitive drum 10 can be developed. Consequently, when the x direction length of the designated color change area is longer than the width direction length of the selected sheet, the rotational positions of magnetic rollers 73 are controlled by controller 61 according to the rotation of photosensitive drum 10 and the exposure scan of the original document. And by the selective operation of developing units 71 and 72, multiple color copying can be executed in the same way as in the first embodiment by a single-pass image formation process.

Next, a third embodiment of the present invention will be described. Those parts which are the same as in the first and second embodiments have been given the same reference number.

Figure 16:
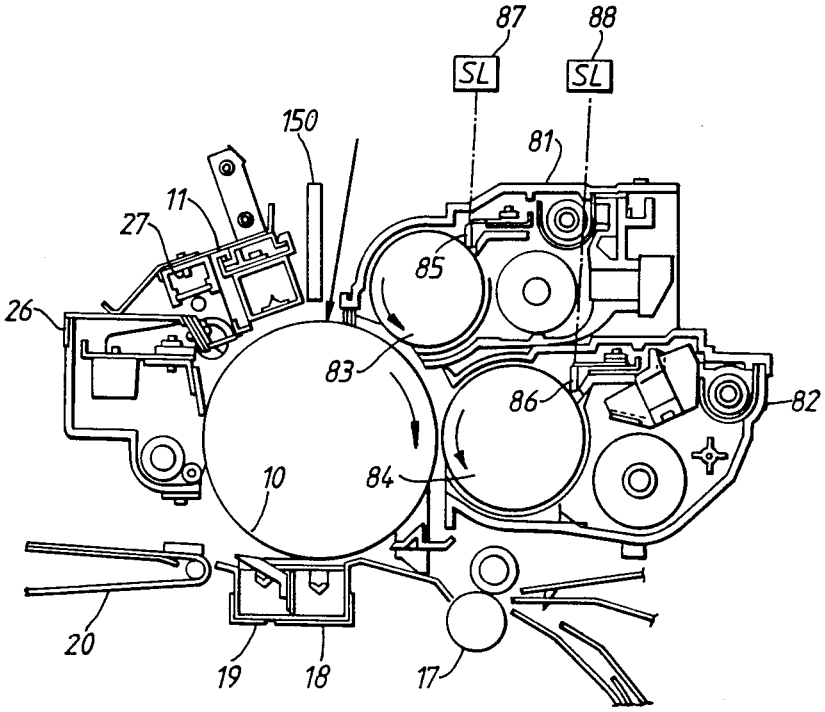
FIGS. 16 is a side sectional view showing the essential part of an image forming apparatus of a third embodiment according to the present invention.

FIG. 16 shows the state when developing units in which the supply of developing agent is controlled by blades. Inside developing units 81 and 82, sleeves 83 and 84 are respectively arranged which are rotated in the directions of the arrows. Blades 85 and 86, which are driven by solenoids 87 and 88, are placed in contact with, or separated from sleeves 83 and 84 respectively. When blades 85 and 86 are placed in contact with sleeves 83 and 84, the developing operation cannot be carried out since the developing agent does not adhere to sleeves 83 and 84. When blades 85 and 86 are separated from sleeves 83 and 84, the developing agent can adhere to sleeves 83 and 84 and so developing can be carried out. Consequently, when the x direction length of the designated color change area is longer than the width direction length of the selected sheet, the placing of blades 85 and 86 in contact with, and their separation from, sleeves 83 and 84 is controlled by controller 61 according to the rotation of photosensitive drum 10 and the exposure scan of the original document. And by the selective operation of developing units 81 and 82, multiple color copying can be executed in the same way as in the first and second embodiment by a single-pass image formation process.

Next, a fourth embodiment of the present invention will be described. Those parts which are the same as in the first to third embodiments have been given the same reference number.

Figure 17:
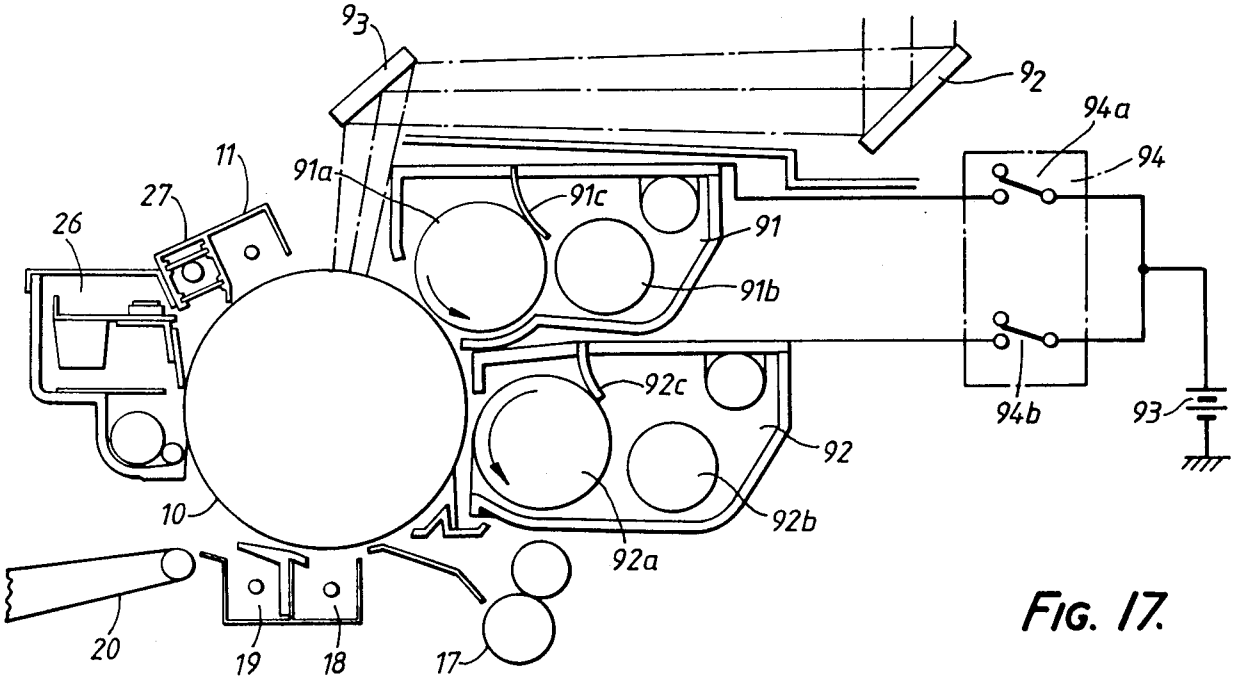
FIGS. 17 is a side sectional view showing the essential part of an image forming apparatus of a fourth embodiment according to the present invention.

FIG. 17 shows the construction of developing units 91 and 92. Developing units 91 and 92 are composed of developing sleeves 91*a* and 92*a*, stirrer rollers 91*b* and 92*b* and blades 91*c* and 92*c* which friction-charge the toner. Black toner is stored in developing unit 91 and red toner is stored in developing unit 92. The gap between developing sleeves 91*a* and 92*a* and photosensitive drum 10 is about 200 μm.

A developing bias voltage is selectively applied to blades 91*c* and 92*c* by a switching circuit 94. When changeover switch 94*a* in switching circuit 94 is turned on, a power source voltage of −500 V as a developing bias voltage from a power source 93 is applied to blade 91*c* of developing unit 91. When changeover switch 94*b* in switching circuit 94 is turned on, the developing bias voltage from power source 93 is applied to blade 92*c* of developing unit 92.

The operation of the above developing units 91 and 92 will be described with reference to FIGS. 11 and 17. Changeover switch 94*a* in switching circuit 94 is turned on from the starting point of the electrostatic latent image of the original document image on photosensitive drum 10 until the developing point of developing unit 91 reaches coordinate $x_1$ and from coordinate $x_2$ until the developing unit point of developing unit 91 reaches the point of completion. By this means, the developing bias voltage from power source 93 is applied to blade 91*c* of developing unit 91. The black toner is friction charged by blade 91*c* of developing unit 91 through this application. Therefore, the black toner is applied to the electrostatic latent image on photosensitive drum 10 from the starting point of the electrostatic latent image to coordinate $x_1$ and from coordinate $x_2$ to the point of completion of the electrostatic latent image to form the black toner image on drum 10.

Also, changeover switch 94*b* in switching circuit 94 is turned on from coordinate $x_1$ to coordinate $x_2$ of the electrostatic latent image of the original document image on photosensitive drum 10. By this means, the developing bias voltage from power source 93 is applied to blade 92*c* of developing unit 92. The red toner is friction charged by blade 92*c* of developing unit 92 through this application. Therefore, the red toner is applied to the electrostatic latent image on photosensitive drum 10 from coordinate $x_1$ to coordinate $x_2$ of the electrostatic latent image to form the red toner image on drum 10.

As described above, in the present invention, an image forming apparatus can be provided which, can shorten the time required for image formation by forming an image of a designated portion and an image of other than that designated portion with a single-pass image formation process when a whole area orthogonal to the direction of scan of an original document is designated. In the present invention, the image forming apparatus can be also provided which, can prevent slippage between the image of the designated portion and the image of other than the designated portion.

Various other modifications could be made in the present invention without departing from the scope or spirit of the following claims.

What is claimed is:

1. An image forming apparatus, comprising:

rotatable image carrier means for carrying electrostatic latent images thereon;

scanning means having a prescribed scanning direction for exposing the image carrier means to form the electrostatic latent images corresponding to the pattern of an original document on the image carrier means;

means for designating first and second rectangular areas of the original document to be copied;

developing means having first and second developing units for converting the electrostatic latent images corresponding to the first and second areas, respectively, into first and second different color toner images on the image carrier means;

means for selectively actuating the first and second developing units; and means for transferring the first and second color toner images from the image carrier means onto a sheet having a defined length and width corresponding to the length and width of the original document in a single rotation of the image carrier means when the widths of both of the first and second areas correspond to the width of the sheet.

2. The apparatus of claim 1 wherein the actuating means includes:

first and second link members each one end of which are respectively connected to the first and second developing units; and cam means connected to each of the other ends of the first and second link members for alternatively moving one of the first and second developing units into and out of association with the image carrier means.

3. The apparatus of claim 1 wherein the first and second developing units each includes a magnetic roller having a plurality of magnetic poles, and a sleeve surrounding the magnetic roller for carrying and transporting the toner to the image carrier means.

4. The apparatus of claim 3 wherein the actuating means includes:

means for forming a magnetic flux at one of the plurality of magnetic poles to inhibit the transportation of the toner carried on the sleeve to the image carrier means; and means for selectively moving the magnetic rollers between a first position in which one of the plurality of magnetic poles is operably associated to form the magnetic flux and a second position in which one of the plurality of magnetic poles is operably disassociated.

5. The apparatus of claim 1 wherein the first and second developing units each includes a rotation sleeve for carrying and transporting the toner to the image carrier.

6. The apparatus of claim 5 wherein the actuating means includes:

a blade member facing each rotation sleeve; and means for selectively moving each blade member between a first portion in which the blade member is contacted with the rotation sleeve to remove the toner carried on the rotation sleeve and a second position in which the blade member is separated from the rotation sleeve to allow the transporation the toner carried on the rotation sleeve onto the image carrier means.

7. The apparatus of claim 1 wherein the first and second developing units each includes a rotation sleeve for carrying and transporting the toner to the image carrier means and blade means for frictionally charging the toner carried on the rotation sleeve.

8. The apparatus of claim 7 wherein the actuating means includes means for selectively applying a developing bias voltage to one of the blade means.

9. The apparatus of claim 8 wherein the applying means includes a power source and a switching circuit for selectively connecting the power source with one of the blade means.

10. An image forming apparatus, comprising:

rotatable image carrier means for carrying electrostatic latent images thereon;

scanning means having a prescribed scanning direction for exposing the image carrier means to form the electrostatic latent images corresponding to the pattern of an original document on the image carrier means;

means for designating first and second rectangular areas of the original document to be copied;

means for comparing the widths of both of the first and second areas with the width of a sheet having a defined length and width in a single rotation of the image carrier means;

means for discriminating whether or not the widths of the first and second areas correspond to the width of the sheet;

developing means having first and second developing units for converting the electrostatic latent images corresponding to the first and second areas, respectively, into first and second different color toner images on the image carrier means;

means for selectively actuating the first and second developing units; and means for transferring the first and second color toner images from the image carrier means onto the sheet when the discriminating means judges the widths of both of the first and second areas substantially equal to the width of the sheet.

* * * * *